US007820351B2

(12) United States Patent
Suzuki et al.

(10) Patent No.: US 7,820,351 B2
(45) Date of Patent: Oct. 26, 2010

(54) NON-MAGNETIC TONER, TWO-COMPONENT DEVELOPER, AND IMAGE FORMING APPARATUS

(75) Inventors: Masao Suzuki, Yamatokoriyama (JP); Yoshiaki Akazawa, Nara (JP); Hiroshi Onda, Yamatokoriyama (JP); Satoshi Ogawa, Nara (JP); Yoshinori Yamamoto, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 899 days.

(21) Appl. No.: 11/645,587

(22) Filed: Dec. 27, 2006

(65) Prior Publication Data

US 2007/0148580 A1 Jun. 28, 2007

(30) Foreign Application Priority Data

Dec. 28, 2005 (JP) ..... P2005-380465

(51) Int. Cl.
*G03G 9/08* (2006.01)

(52) U.S. Cl. ..... 430/110.4

(58) Field of Classification Search ..... 430/110.4; 399/258

See application file for complete search history.

(56) References Cited

U.S. PATENT DOCUMENTS

| | | | | |
|---|---|---|---|---|
| 4,985,327 | A | 1/1991 | Sakashita et al. | |
| 5,548,379 | A * | 8/1996 | Fukuchi et al. | 399/116 |
| 5,976,750 | A | 11/1999 | Hagi et al. | |
| 6,461,783 | B1 * | 10/2002 | Kim et al. | 430/110.4 |
| 2005/0277048 | A1 | 12/2005 | Tomita | |
| 2009/0041505 | A1 | 2/2009 | Tomita | |

FOREIGN PATENT DOCUMENTS

| | | |
|---|---|---|
| JP | 2-000877 | 1/1990 |
| JP | 6-59501 A | 3/1994 |
| JP | 10-91000 | 4/1998 |
| JP | 10-207112 | 8/1998 |
| JP | 2005-43918 | 2/2005 |

OTHER PUBLICATIONS

Diamond, Arthur S & David Weiss (eds.) Handbook of Imaging Materials, 2nd ed.. New York: Marcel-Dekker, Inc. (Nov. 2001) pp. 209-220.*

Diamond, Arthur S & David Weiss (eds.) Handbook of Imaging Materials, 2nd ed.. New York: Marcel-Dekker, Inc. (Nov. 2001) pp. 145-164.*

* cited by examiner

*Primary Examiner*—Christopher RoDee
(74) *Attorney, Agent, or Firm*—Nixon & Vanderhye P.C.

(57) ABSTRACT

An image forming apparatus for forming images with a toner and includes an image forming section, a paper feeding section and an image reading section, in which the non-magnetic toner is as follows: the particle size $D_{10V}$ and the particle size $D_{90V}$ of the toner satisfy the following formula (1), the particle size $D_{50V}$ is from 5 to 8 μm, and the content of the toner particles having a particle size of at most 5 μm is from 15 to 35% by number:

$$0.415 \leqq (D_{10V} - D_{90V})/D_{10V} \leqq 0.475 \quad (1)$$

wherein $D_{10V}$, $D_{50V}$ and $D_{90V}$ each are a particle size where a cumulative volume from the large particle size side in the cumulative volume distribution of the toner particles reaches 10%, 50% and 90%, respectively.

6 Claims, 2 Drawing Sheets

NON-MAGNETIC TONER, TWO-COMPONENT DEVELOPER, AND IMAGE FORMING APPARATUS

CROSS-REFERENCE TO RELATED APPLICATION

This application claims priority to Japanese Patent Application No. JP 2005-380465, which was filed on Dec. 28, 2005, the contents of which, are incorporated herein by reference, in their entirety.

BACKGROUND OF THE INVENTION

1. Field of the Invention

The present invention relates to a non-magnetic toner, a two-component developer and an image forming apparatus.

2. Description of the Related Art

An electrophotographic image forming apparatus comprises image forming process mechanisms such as a photoreceptor, a charging section for charging the photoreceptor surface, an exposure section for irradiating the charged photoreceptor surface with signal light to thereby form thereon an electrostatic latent image corresponding to image information, a developing section for supplying a toner in a developer to the electrostatic latent image on the photoreceptor surface to thereby form thereon a toner image, a transfer section for transferring the toner image from the photoreceptor surface onto a recording medium, a fixing section for fixing the toner image on the recording medium, and a cleaning section for cleaning the photoreceptor surface after the toner image transference, in which the electrostatic latent image is developed with a one-component developer that contains a toner alone or with a two-component developer that contains a toner and a carrier, thereby forming an image.

Such an electrophotographic image forming apparatus may form a good image of high quality at high speed and inexpensively, and is therefore utilized in duplicators, printers, facsimiles, etc., and the spread of the apparatus is remarkable these days. With that, the requirements of image forming apparatus are being much severer. In particular, high definition and high resolution of images to be formed, stabilization of image quality and high-speed image formation in image forming apparatus are regarded as important. To attain these, investigation of both an image forming process and a developer is indispensable.

Regarding the requirement for high-definition and high-resolution images in terms of the developer to be used for image formation, one problem to be solved is how to reduce the size of toner particles from the viewpoint that faithful reproduction of electrostatic latent images is important, and various proposals have been made for it.

For example, a non-magnetic toner is proposed, of which the particle size distribution satisfies the following: The content of the toner particles having a particle size of at most 5 μm is from 17 to 60% by number, the content of the toner particles having a particle size of from 8 to 12.7 μm is from 1 to 30% by number, the content of the toner particles having a particle size of at least 16 μm is at most 2.0% by volume, the volume-average particle size is from 4 to 10 μm, the toner particles having a particle size of at most 5 μm satisfies $N/V=-0.04N+k$ (wherein N indicates % by number of the toner particles having a particle size of at most 5 μm, and is a positive number of from 17 to 60; V indicates % by volume of the toner particles having a particle size of at most 5 μm; k indicates a positive number of from 4.5 to 6.5) (e.g., see Japanese Unexamined Patent Publication JP-A 2-877 (1990)). The technique in JP-A 2-877 is to overcome the drawback of the toner particles having a particle size of at most 5 μm in that, since the electric field intensity at the edges of an electrostatic latent image is higher than that in the center thereof, the amount of the toner particles to adhere to the center part of the electrostatic latent image is smaller than that to adhere to the edges thereof whereby the image density lowers, by specifically defining the content of the toner particles having a particle size of at most 5 μm to be within a specific range. The non-magnetic toner in JP-A 2-877 may be advantageous for high-definition and high-resolution image formation, but its flowability is poor, and therefore scattering of the toner may tend to soil machines. In particular, in a low-humidity environment, the toner particles may be overcharged (charge-up), and the overcharged toner particles may firmly adhere to the carrier surface in a developer and to the photoreceptor surface thereby causing image fogging, photoreceptor cleaning failure, and filming on photoreceptor, and therefore detracting from the durability of both the image forming process and the developer. In addition, the toner particles may readily form their aggregates to cause white skip in images.

A toner is also proposed which has a mean particle size of from 5 to 10 μm and in which the content of the toner particles having a particle size of at most 5 μm is at most 10% by number (e.g., see Japanese Unexamined Patent Publication JP-A 10-91000 (1998)). In the toner, the content of the toner particles having a particle size of at most 5 μm is too small, and therefore the toner is unsuitable for high-definition and high-resolution image formation.

Also proposed is a toner comprising toner particles that contain a binder resin and a colorant, and an external additive added thereto, wherein the toner particles satisfies $1.45-0.05D_{50} \leqq D_{25}/D_{75} \leqq 1.75-0.05D_{50}$ (in which $D_{25}$, $D_{50}$ and $D_{75}$ each indicate the particle size where a cumulative volume from the large particle size side in a cumulative volume distribution of the particles reaches 25%, 50% and 75%, respectively), $D_{50}$ is from 3 to 7 μm, the external additive comprises hydrophobic inorganic particles having a number-average particle size of from 5 to 70 nm and inorganic particles having a number-average particle size of from 80 to 800 nm in which the content of the particles having a particle size of at least 1000 nm is at most 20% by number (e.g., see Japanese Unexamined Patent Publication JP-A 10-207112 (1998)). The toner has good flowability, prevents image fogging, and has good photoreceptor cleanability, but is not still effective for high-definition and high-resolution image formation.

Also proposed is a toner of such that the content of the toner particles having a particle size of at most 5 μm is at most 15% by number, the toner has a weight-average particle size of from 6.0 to 11.5 μm, the content of the toner particles having a particle size of at least two times the weight-average particle size thereof is at most 5% by volume, and the ratio of the number-average particle size D25 to D75 (D25/D75) where a cumulative number distribution of the toner reaches 25% and 75%, respectively is from 0.60 to 0.80 (e.g., see Japanese Unexamined Patent Publication JP-A 2005-43918). The toner also has good flowability, prevents image fogging, and has good photoreceptor cleanability, but is ineffective for high-definition and high-resolution image formation, like the toner in JP-A 10-207112.

SUMMARY OF THE INVENTION

An object of the invention is to provide a non-magnetic toner, which has good flowability and is effective for high-definition and high-resolution image formation, which, even when used in high-speed processors (image forming apparatus capable of being driven at high speed for image formation), is free from in-machine trouble of scattering, image failures of fogging and hollow defects, and filming, which has good cleanability on photoreceptor, and which can stably form high-quality images capable of faithfully reproducing image information, for a long period of time; and to provide a two-component developer containing the toner, and an image forming apparatus using them.

The inventors of the invention have assiduously studied for the purpose of solving the above problems, and, as a result, have succeeded in obtaining a toner having a specific particle size distribution and capable of satisfying the object of the invention even though a ratio of the toner particles having a particle size of at most 5 μm is relatively large which is in a range of from 15 to 35% by number, and have completed the invention.

The invention provides a non-magnetic toner comprising a binder resin and a colorant, in which the particle size $D_{10V}$ where a cumulative volume from the large particle size side in the cumulative volume distribution reaches 10%, and the particle size $D_{90V}$ where a cumulative volume from the large particle size side in the cumulative volume distribution reaches 90% satisfy the following formula (1), the particle size $D_{50V}$ where a cumulative volume from the large particle size side in the cumulative volume distribution reaches 50% falls within a range of from 5 to 8 μm (5 μm or more and 8 μm or less), and a content of the toner particles having a particle size of at most 5 μm is from 15 to 35% by number (15% by number or more and 35% by number or less):

$$0.415 \leqq (D_{10V}-D_{90V})/D_{10V} \leqq 0.475 \quad (1).$$

According to the invention, a non-magnetic toner comprising a binder resin and a colorant is provided, in which the particle size $D_{10V}$ and the particle size $D_{90V}$ satisfy the formula (1), the particle size $D_{50V}$ is within a range of from 5 to 8 μm, and the content of the toner particles having a particle size of at most 5 μm is from 15 to 35% by number. Though the non-magnetic toner of the invention contains a relatively large amount of toner particles having a particle size of at most 5 μm, which may cause the reduction in the flowability of the toner, it may have good flowability as it has the specific particle size distribution. Accordingly, when the non-magnetic toner of the invention is used, then it does not scatter inside an image forming apparatus, it does not cause image failures of fogging and hollow defects, and it is free from filming on photoreceptor, and therefore its cleaning on photoreceptor is extremely easy. In addition, since it has good flowability, the toner supply mechanism and the photoreceptor cleaning mechanism in an image forming apparatus may be simplified, and it contributes to down-sizing and cost-reduction of apparatus. Moreover, since the toner is effective for high-definition and high-resolution image formation and has good image reproducibility (especially, fine line reproducibility), it may form high-quality images. Further, the non-magnetic toner of the invention is well applicable to high-speed machines that are at present the mainstream of the art, and even in image forming apparatus that will be used over the predetermine durability period thereof, the toner may have sufficient flowability and may be effective for high-definition and high-resolution image formation, and is therefore free from a trouble of image quality degradation.

In the invention, it is preferable that the particle size $D_{50V}$ where a cumulative volume from the large particle size side in the cumulative volume distribution reaches 50% and the particle size $D_{90V}$ where a cumulative volume from the large particle size side in the cumulative volume distribution reaches 90% satisfy the following formula (2):

$$0.160 < (D_{50V}-D_{90V})/D_{50V} < 0.255 \quad (2).$$

According to the invention, the particle size $D_{50V}$ and the particle size $D_{90V}$ of the non-magnetic toner of the invention preferably satisfy the formula (2). The non-magnetic toner has the excellent effects as above, in which, in addition, the content of the toner particles having a particle size of at most 3 μm that may readily adhere to a developing roller, as provided inside a developing apparatus to directly supply toner to the electrostatic latent image on a photoreceptor therein, may be further reduced, and therefore it may further prolong the durability life of the image forming apparatus using it. Moreover, when used in a two-component developer, the toner particles having a particle size of at most 3 μm may adhere to the carrier surface to shorten the durability life of the two-component developer, but since the content of the toner particles is reduced in the toner of the invention, the toner enables high-quality image formation for a longer period of time.

Further, in the invention, a content of the toner particles having a particle size of from 3 to 5 μm (3 μm or more and 5 μm or less) is from 13 to 30% by number (13% by number or more and 30% by number or less).

According to the invention, the content of the toner particles having a particle size of from 3 to 5 μm in the non-magnetic toner of the invention is preferably from 13 to 30% by number. The non-magnetic toner may form images of further better quality, and may more surely prevent image fogging.

Further, in the invention, it is preferable that a mean degree of circularity of the toner particles is from 0.94 to 1.0 (0.94 or more and 1.0 or less).

According to the invention, the mean degree of circularity of the toner particles in the non-magnetic toner of the invention is preferably from 0.94 to 1.0. The non-magnetic toner may more surely attain faithful development of electrostatic latent images and transferring of toner images onto a recording medium, still keeping its intrinsic flowability. Accordingly, since the initial high-quality images formed with the toner in an image forming apparatus do not deteriorate at all even after use of the toner therein for a long period of time, and the toner enables to keep stable and high-level image characteristics.

Further, in the invention, it is preferable that the non-magnetic toner is produced by roughly grinding a melt-kneaded material of a binder resin and a master batch containing a colorant, and then finely grinding and classifying the resultant with a fluidized-bed jet grinder.

According to the invention, the non-magnetic toner having a specific particle size distribution of the invention can be obtained, for example, by roughly grinding a melt-kneaded material of a binder resin and a master batch containing a colorant, and then finely grinding and classifying it with a fluidized-bed jet grinder.

Furthermore, the invention provides a two-component developer comprising any one of the non-magnetic toners mentioned above and a carrier.

Furthermore, in the invention, it is preferable that the particle size of the carrier is from 30 to 50 μm (30 μm or more and 50 μm or less).

According to the invention is provided a two-component developer containing any one of the non-magnetic toners mentioned above and a carrier (preferably a small-size carrier having a particle size of from 30 to 50 μm). Using the two-component developer of the invention makes it possible to form high-quality images within the durability period of the image forming apparatus used with it, and makes it possible to prolong the durability period of image forming apparatus.

Furthermore, the invention provides an image forming apparatus for electrophotography, comprising a photoreceptor, a charging section for charging a surface of the photoreceptor, an exposure section for irradiating the charged photoreceptor surface with signal light to thereby form thereon an electrostatic latent image corresponding to image information, a developing section for supplying a toner in a developer to the electrostatic latent image on the photoreceptor surface to thereby form thereon a toner image, a transfer section for transferring the toner image from the photoreceptor surface onto a recording medium, a fixing section for fixing the toner image on the recording medium, and a cleaning section for cleaning the photoreceptor surface after the toner image transference, wherein a two-component developer is used which is any one of the two-component developers mentioned above, and the cleaning section includes a cleaning blade provided to be in contact under pressure or under no pressure with the photoreceptor surface.

According to the invention is provided an electrophotographic image forming apparatus that uses a two-component developer containing any one of the non-magnetic toners mentioned above. The non-magnetic toner of the invention that may remain on a photoreceptor surface after transfer of a toner image onto a recording medium may be readily removed with a cleaning blade, and therefore the cleaning mechanism in the image forming apparatus may be simplified. Using the non-magnetic toner of the invention, the image forming apparatus of the invention may be down-sized and, in addition, its cost may be reduced.

In the invention, it is preferable that a toner storage section for storing toner therein, and a toner supply pipe having one end connected with the toner storage section and another end connected with a developing section so as to supply the toner in the toner storage section to the developing section are provided.

According to the invention, the non-magnetic toner of the invention to be used in the image forming apparatus of the invention has excellent flowability, and therefore the toner supply mechanism to the developing apparatus may be simplified and, in addition, the apparatus may be down-sized and its cost may be reduced. Specifically, even in a simple mechanism where a toner storage container such as a toner cartridge and a developing apparatus are connected to each other via a toner supply pipe therebetween, the toner does not clog the system and may be smoothly supplied to the developing apparatus.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1:
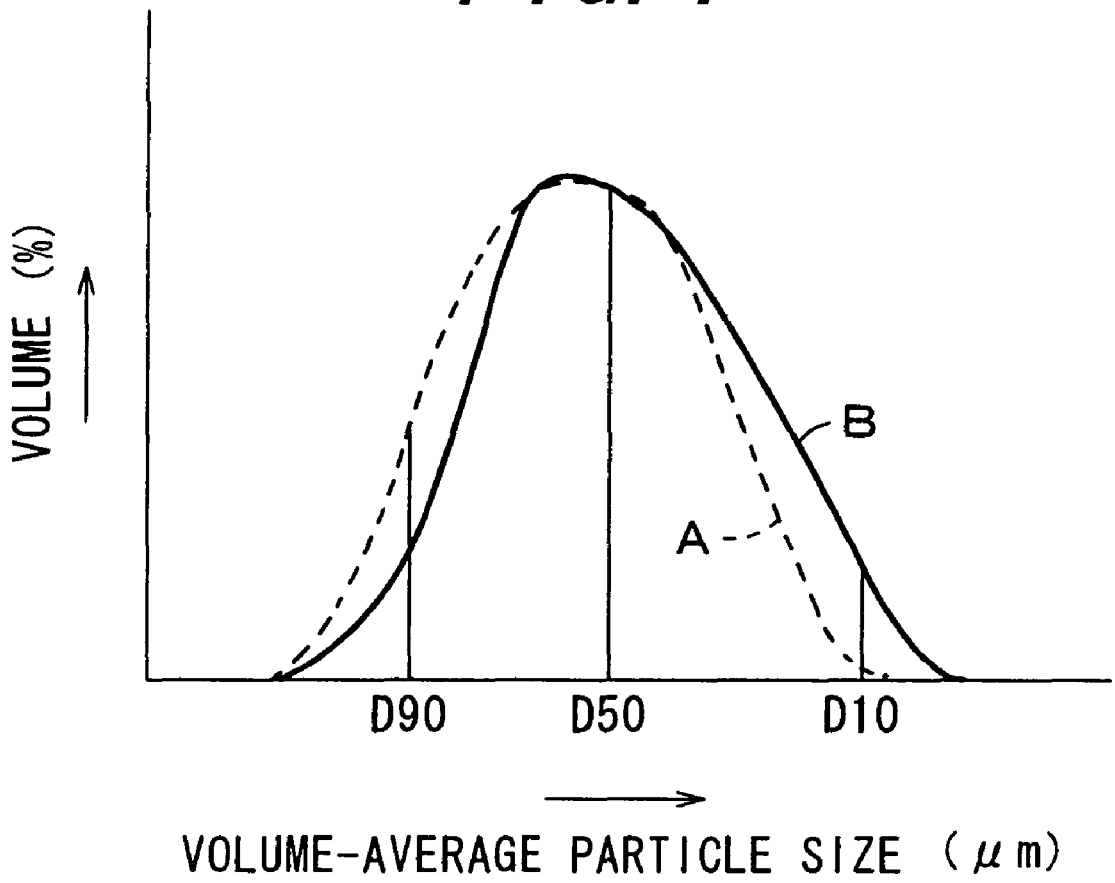
FIG. 1 is a graph showing the outline of a volume distribution of conventional toner particles (A) and toner particles of the invention (B)

Now referring to the drawings, preferred embodiments of the invention are described below.

The non-magnetic toner of the invention is a granular substance containing a binder resin and a colorant as the indispensable ingredients thereof, and has a specific particle size distribution mentioned below.

(a) The particle size $D_{10V}$ where a cumulative volume from the large particle size side in the cumulative volume distribution reaches 10% and the particle size $D_{90V}$ where a cumulative volume from the large particle size side in the cumulative volume distribution reaches 90% satisfy the following formula (1):

$$0.415 \leqq (D_{10V}-D_{90V})/D_{10V} \leqq 0.475 \quad (1).$$

When the value is less than 0.415, then the particle size distribution of the non-magnetic toner may be extremely narrow, and the classification may be complicated in producing the non-magnetic toner and, in addition, the yield after the classification may greatly lower and the production of the toner is impracticable. When larger than 0.475, then the charging amount distribution of the non-magnetic toner may be too broad, as the result, that the toner may scatter inside the image forming apparatus using it and may cause image fogging.

(b) The particle size $D_{50V}$ where a cumulative volume from the large particle size side in the cumulative volume distribution of the toner reaches 50% is from 5 to 8 μm.

When the particle size $D_{50V}$ is less than 5 μm, then the flowability of the non-magnetic toner may lower and, in addition, the toner may readily aggregate with the result that the toner may be difficult to uniformly mix with a carrier within a short period of time and the number of the toner particles that could not sufficiently charge may increase. Accordingly, the non-image area may be fogged. In addition, since the charging amount per the unit weight of the toner may too much increase and the developability with the toner may extremely lower. Furthermore, there may occur still another problem in terms of its production in that the yield in grinding and classifying the toner lowers and the cost of the toner is thereby increased.

When the particle size $D_{50V}$ is more than 8 μm, then faithful dot reproduction of electrostatic latent images would be difficult and the image reproducibility and resolution may lower. Further, the granularity of the non-magnetic toner may worsen with the result that the images formed with the toner may be rough and the image quality may lower. Moreover, some excessive toner over the necessary amount thereof may adhere to electrostatic latent images and the amount of the toner to be consumed may increase. "Rough" images mean uneven images having a rough appearance.

(c) The content of the toner particles having a particle size of at most 5 μm is from 15 to 35% by number.

When the content is less than 15% by number, then the image reproducibility and the resolution may be poor, and the image quality of the images formed may worsen. On the other hand, when it is more than 35% by number, then the charging amount distribution of the toner may be broad, thereby readily causing photoreceptor cleaning failure and shortening the durability period of image forming apparatus. In addition, since the toner particles may readily aggregate, there may occur hollow defects of images owing to the influence of the toner aggregates larger than the original toner particles and the image resolution may thereby lower.

Further, the non-magnetic toner of the invention is preferably such that the particle size $D_{50V}$ where a cumulative volume from the large particle size side in the cumulative volume distribution reaches 50% and the particle size $D_{90V}$ where a cumulative volume from the large particle size side in the cumulative volume distribution reaches 90% satisfy the following formula (2):

$$0.160 < (D_{50V}-D_{90V})/D_{50V} < 0.255 \quad (2).$$

When $(D_{50V}-D_{90V})/D_{50V}$ falls within the range, then the content of the toner particles having a particle size of at most 3 μm, which especially may cause the reduction in the aggregation capability of the toner particles and which may therefore readily keep excessive charges (Q/m) and may readily adhere to the surfaces of developing roller and carrier, may be reduced, while the content of the toner particles having a particle size of at most 5 μm that may contribute to high-definition and high-resolution image formation may be kept as such, and accordingly, the toner may produce good images of high quality more stably for a further longer period of time. When the value is less than 0.160, then the toner producibility may greatly lower and is therefore impracticable. When larger than 0.255, then the toner may firmly stick to a developing roller and a carrier, thereby causing troubles of toner scattering and image failures of fogging and hollow defects. The troubles may be more noticeable as the period for which the toner is used in an image forming apparatus is longer.

Further, in the non-magnetic toner of the invention, the content of the toner particles having a particle size of from 3 to 5 μm is preferably from 13 to 30% by number. When the content is less than 13% by number, then high-definition and high-resolution image formation with the toner would be insufficiently realized. When larger than 30% by number, then the toner may readily aggregate and the toner chargeability may lower, and therefore image fogging may increase.

Further, the non-magnetic toner of the invention is preferably such that the mean degree of circularity thereof is from 0.94 to 1.0. When the mean degree of circularity falls within the range, then the toner flowability, the electrostatic latent image developability with the toner and the transferability of the toner image onto recording media may be further bettered and images of further better quality may be stably formed for a long period of time. When the value is less than 0.94, then the toner particles may have sharp edges and excessive charges may concentrate at the sharp edges with the result that the developability and the transferability may lower. In addition, the toner flowability may also lower, and with the increase in the number of prints to be formed with the toner, the amount of the unfavorably-charged toner may increase, thereby often causing printing troubles of image fogging and toner scattering. In addition, owing to the stress that the sharp edges of the toner may have inside a developing apparatus, the toner particles may readily break and drop off, and therefore, with the increase in the number of prints to be formed with the toner, the powder that results from the sharp edges of the toner may increase inside the developing apparatus, and as a result, the toner flowability may lower and the amount of the unfavorably-charged toner may increase, therefore often causing printing troubles of image fogging and toner scattering. The degree of circularity of 1.0 means true spheres, and it should not be more than 1.0.

The non-magnetic toner of the invention may be produced by roughly grinding a melt-kneaded toner material, then finely grinding it with a fluidized-bed jet grinder and optionally classifying it.

The toner material comprises a binder resin and a colorant as the indispensable ingredients thereof, and may additionally contain a charge controller, a lubricant and a flowability improver.

Not specifically defined, the binder resin may be any binder resin known for black toner or color toner. For example, it includes polyester resins; styrenic resins such as polystyrene, styrene-acrylate copolymer resins; acrylic resins such as polymethyl methacrylate; polyolefinic resins such as polyethylene; polyurethane, epoxy resins. Also usable is a resin obtained by adding a lubricant to a starting monomer mixture followed by polymerizing it. One or more different types of binder resins may be used herein either singly or as combined.

The colorant for use herein may be any ordinary one generally used in the art, for example, including colorants for yellow toner, colorants for magenta toner, colorants for cyan tone, colorants for black toner.

The colorants for yellow toner are, for example, azo pigments such as C.I. pigment yellow 1, C.I. pigment yellow 5, C.I. pigment yellow 12, C.I. pigment yellow 15, C.I. pigment yellow 17; inorganic pigments such as yellow iron oxide, Chinese yellow; nitro dyes such as C.I. acid yellow 1; and oil-soluble dyes such as C.I. solvent yellow 2, C.I. solvent yellow 6, C.I. solvent yellow 14, C.I. solvent yellow 15, C.I. solvent yellow 19, C.I. solvent yellow 21, as classified by Color Index.

The colorants for magenta toner are, for example, C.I. pigment red 49, C.I. pigment red 57, C.I. pigment red 81, C.I. pigment red 122, C.I. solvent red 19, C.I. solvent red 49, C.I. solvent red 52, C.I. basic red 10, C.I. disperse red 15, as classified by Color Index.

The colorants for cyan toner are, for example, C.I. pigment blue 15, C.I. pigment blue 16, C.I. solvent blue 55, C.I. solvent blue 70, C.I. direct blue 25, C.I. direct blue 86, as classified by Color Index.

The colorants for black toner are, for example, carbon black such as channel black, roller black, disc black, gas furnace black, oil furnace black, thermal black, acetylene black. From these various types of carbon black, suitable ones may be appropriately selected in accordance with the planning characteristics of the toner to be obtained.

Apart from those pigments, also usable herein are other red pigments and green pigments. One or more different types of colorants may be used either singly or as combined. Two or more colorants of the same color type may be combined, or one or more colorants of one color type may be combined with those of a different color type.

The colorant may be used as a master batch. The colorant master batch may be produced in the same manner as that for ordinary master batches. For example, a synthetic resin melt is kneaded with a colorant so that the colorant is uniformly dispersed in the synthetic resin, and then the resulting melt-kneaded matter is granulated to give the intended master batch. The synthetic resin may be the same type as that of the toner binder resin, or it may be any one compatible with the toner binder resin. Not specifically defined, the blend ratio of the synthetic resin to the colorant is preferably such that the amount of the colorant is from 30 to 100 parts by weight relative to 100 parts by weight of the synthetic resin. For example, the master batch is granulated into granules having a size of from 2 to 3 mm or so.

Also it is not specifically defined, but the content of the colorant is preferably such that the amount of the colorant is from 4 to 20 parts by weight relative to 100 parts by weight of the binder resin. This is not the amount of the colorant in the master batch but is the amount thereof actually in the toner. Accordingly, the amount of the colorant in the master batch is preferably so controlled that the amount thereof in the toner could be within the range as above. When the amount of the colorant in the toner falls within the range, then extremely good images of high quality having a high image density can be formed without detracting from the physical properties of the toner.

The charge controller may be any ordinary positive charge controller or negative charge controller generally used in the art. The positive charge controller includes, for example, nigrosine dyes, basic dyes, quaternary ammonium salts, quaternary phosphonium salts, aminopyrines, pyrimidine compounds, polynuclear polyamino compounds, aminosilanes, nigrosine dyes and their derivatives, triphenylmethane derivatives, guanidine salts, and amidine salts. The negative charge controller includes, for example, oil-soluble dyes such as oil black, Spiron black, and metal-containing azo compounds, azo complex dyes, metal naphthenates, metal complexes and metal salts of salicylic acid and its derivatives (in which the metal is chromium, zinc, zirconium, etc.), boron compounds, fatty acid soap, long-chain alkylcarboxylic acid salts, resin acid soap. One or more different types of charge controllers may be used herein either singly or optionally as combined. Not specifically defined, the amount of the charge controller may be selected from a broad range, but is preferably from 0.5 to 3 parts by weight relative to 100 parts by weight of the binder resin.

The lubricant may be any ordinary one generally used in the art. For example, it includes petroleum wax such as paraffin wax and its derivatives, microcrystalline wax and its derivatives; hydrocarbon-based synthetic wax such as Fischer-Tropsch wax and its derivatives, polyolefin wax and its derivatives, low-molecular-weight polypropylene wax and its derivatives, polyolefinic polymer wax (low-molecular-weight polyethylene wax, etc.) and its derivatives; vegetable wax such as carnauba wax and its derivatives, rice wax and its derivatives, candelilla wax and its derivatives, haze wax; animal wax such as bees wax, spermaceti wax; fat and oil-based synthetic wax such as fatty acid amides, phenolic fatty acid esters; and long-chain carboxylic acids and their derivatives, long-chain alcohols and their derivatives, silicone polymers, and higher fatty acids. The derivatives include oxides, block copolymers of vinylic monomer and wax, graft-modified derivatives of vinylic monomer and wax. Not specifically defined, the amount of the wax to be used may be selected from a broad range, but is preferably from 0.2 to 20 parts by weight relative to 100 parts by weight of the binder resin.

The flowability improver is used as an external additive. For example, it adheres to the toner surface thereby exhibiting its effect. The flowability improver may be any ordinary one generally used in the art. For example, it includes silicon oxide, titanium oxide, silicon carbide, aluminium oxide, and barium titanate. One or more such flowability improvers may be used herein either singly or as combined. Not specifically defined, the amount of the flowability improver to be used is preferably from 0.1 to 3.0 parts by weight relative to 100 parts by weight of the toner particles.

Except the external additives thereto, the toner material is mixed in a mixture such as a Henschel mixer, a super-mixer, a mechanomill or a Q-type mixer, and the resulting mixture may be melt-kneaded in a kneader such as a double-screw kneader, a single-screw kneader or a continuous two-roll kneader at a temperature of from 70 to 180° C. or so. Thus obtained, the melt-kneaded toner material is cooled and solidified.

After cooled and solidified, the melt-kneaded toner material is roughly ground with a cutter mill or a feather mill. Thus roughly ground, the resulting matter is then finely ground. For finely grinding it, usable is a particle-to-particle collision-type jet mill or a fluidized-bed jet grinder. In these grinding machines, the toner particles are ground in such a manner that jet streams that contain the toner particles are made to collide with each other in different directions whereby the toner particles are made to collide with each other and are thus ground. Such grinding machines are commercially sold, for example, by Hosokawa Micron. Accordingly, a non-magnetic toner having a specific particle size distribution as defined in the invention can be produced. If desired, the toner may be subjected to particle size control such as classification. For obtaining the non-magnetic toner of the invention, it is important that a master batch containing a colorant is used, and that a cooled and solidified matter of a melt-kneaded toner material is once roughly ground and then finely ground. Even though the cooled and solidified matter is finely ground directly as it is, the intended non-magnetic toner having a desired particle size distribution could not be obtained. In addition, even though the roughly-ground matter is finely ground in a grinder except those acting on the basis of the above-mentioned grinding principle, for example a particle-to-plate collision-type jet mill (in which toner particles are made to run along with jet streams, then made to collide against a baffle plate, and are thereby ground), a non-magnetic toner having a desired particle size distribution could not be obtained.

When the rough grinding is combined with the fine grinding with a fluidized-bed jet grinder and when the ground powder is classified with a rotary pneumatic classifier (rotor-assisted classifier), the non-magnetic toner of the invention could not always be obtained, or that is, the non-magnetic toner of the invention could be obtained or, as the case may be, could not be obtained, depending on the grinding condition and the classification condition. One example of the condition under which the non-magnetic toner of the invention can be obtained is as follows: The number of revolution of the rotor in the fluidized-bed jet grinder is from 3000 to 4850 rpm, the number of revolution of the rotor in the rotary pneumatic classifier is from 3100 to 3950 rpm, the amount of the ground powder to be fed to the rotary pneumatic classifier is from 15 to 50 kg/h, and the air flow rate in the rotary pneumatic classifier is from 15.0 to 17.0 $Nm^3/m$. Suitably selecting the driving condition from the ranges as above makes it possible to give the non-magnetic toner having the specific particle size distribution as defined in the invention.

Thus obtained, the toner particles have a volume distribution as in FIG. 1. FIG. 1 is a graph showing the outline of a volume distribution of toner particles (A) and toner particles of the invention (B). The dotted line A indicates conventional toner particles (toner particles of JP-A 2-877 (1990)); and the full line B indicates the toner particles of the invention. In FIG. 1, the horizontal axis is a volume-average particle size (μm); and the vertical axis is a ratio of the volume of the toner particles having the indicated volume-average particle size (μm) to the overall volume of the toner particles. As in FIG. 1, the volume distribution profile of the toner particles of the invention is as follows: The curve from $D_{50V}$ to $D_{10V}$ on the large particle size side of the toner particles of the invention is broader (gentler) than that of the conventional toner particles, and this confirms that the toner particles of the invention have good flowability and can readily reproduce half-tone images. In addition, the curve from $D_{50V}$ to $D_{90V}$ on the small particle size side is steeper than that of the conventional toner particles, indicating that the toner of the invention is free from troubles of toner scattering and image fogging and is excellent in terms of the image reproducibility thereof as it contains a predetermined amount of small-size toner particles.

Having the specific particle size distribution as above, the non-magnetic toner of the invention successfully satisfies the two requirements of image reproducibility and flowability, which have heretofore been considered as contradictory characteristics in conventional toners, at a high level.

The toner particles may be used as such as the non-magnetic toner of the invention; and if desired, the toner particles may be mixed with any external additives to be the non-magnetic toner of the invention.

The two-component developer of the invention contains the non-magnetic toner of the invention and a carrier. The carrier may be any known magnetic particles. Examples of the magnetic particles are metals such as iron, ferrite, magnetite; and their alloys with any other metals such as aluminium or lead. Of those, preferred is ferrite.

Resin-coated magnetic particles, or magnetic particles dispersed in resin (resin dispersion-type carrier) may also be used as the carrier. Not specifically defined, the resin to coat the magnetic particles includes, for example, olefinic resins, styrenic resins, styrene/acrylic resins, silicone resins, ester resins, fluorine-containing polymer resins. Also not specifically defined, the resin for the resin dispersion-type carrier includes, for example, styrene-acrylic resins, polyester resins, fluororesins, phenolic resins.

Regarding its form, the carrier is preferably spherical or flat.

Not specifically defined, the particle size of the carrier is preferably from 30 to 50 μm in consideration of formation of high-quality images.

Preferably, the resistivity of the carrier is at least $10^8$ Ω·cm, more preferably at least $10^{12}$ Ω·cm. The resistivity is determined as follows: the particles to be analyzed are put into a container having a cross section of 0.50 $cm^2$, then tapped, and a load of 1 $kg/cm^2$ is applied onto the particles thus charged in the container, and a voltage to give an electric field of 1000 V/cm between the load and the bottom electrode is applied to it, whereupon the current value is read. From this, the resistivity of the carrier is derived. In a case where the resistivity of the carrier is low, then the carrier particles may readily receive charges when a bias voltage is applied to the developing sleeve and therefore the carrier particles may readily adhere to the image carrier surface, and in addition, the bias voltage may often break down.

The magnetization strength (maximum magnetization) of the carrier is preferably from 10 to 60 emu/g, more preferably from 15 to 40 emu/g. Though depending on the magnetic flux density on a developing roller, the magnetization strength of less than 10 emu/g would be ineffective for magnetic restraint power of the carrier under an ordinary magnetic flux density condition of a developing roller, and it may cause a trouble of carrier scattering. On the other hand, when it is more than 60 emu/g, then in non-contact development where the carrier particles may stand too high like needles, it would be difficult to keep the non-contact state of the carrier particles with an image carrier, and in contact development, the toner image may have cleaning streaks.

Not specifically defined, the blend ratio of the toner and the carrier in the two-component developer of the invention may be suitably selected depending on the type of the toner and the carrier. One example of a resin-coated carrier (having a density of from 5 to 8 $g/cm^2$) is described. The amount of the toner in the developer may be from 2 to 30% by weight, preferably from 2 to 20% by weight of the overall weight of the developer.

In the two-component developer of the invention, the coverage ratio of the carrier by the toner is preferably from 40 to 80%.

Figure 2:
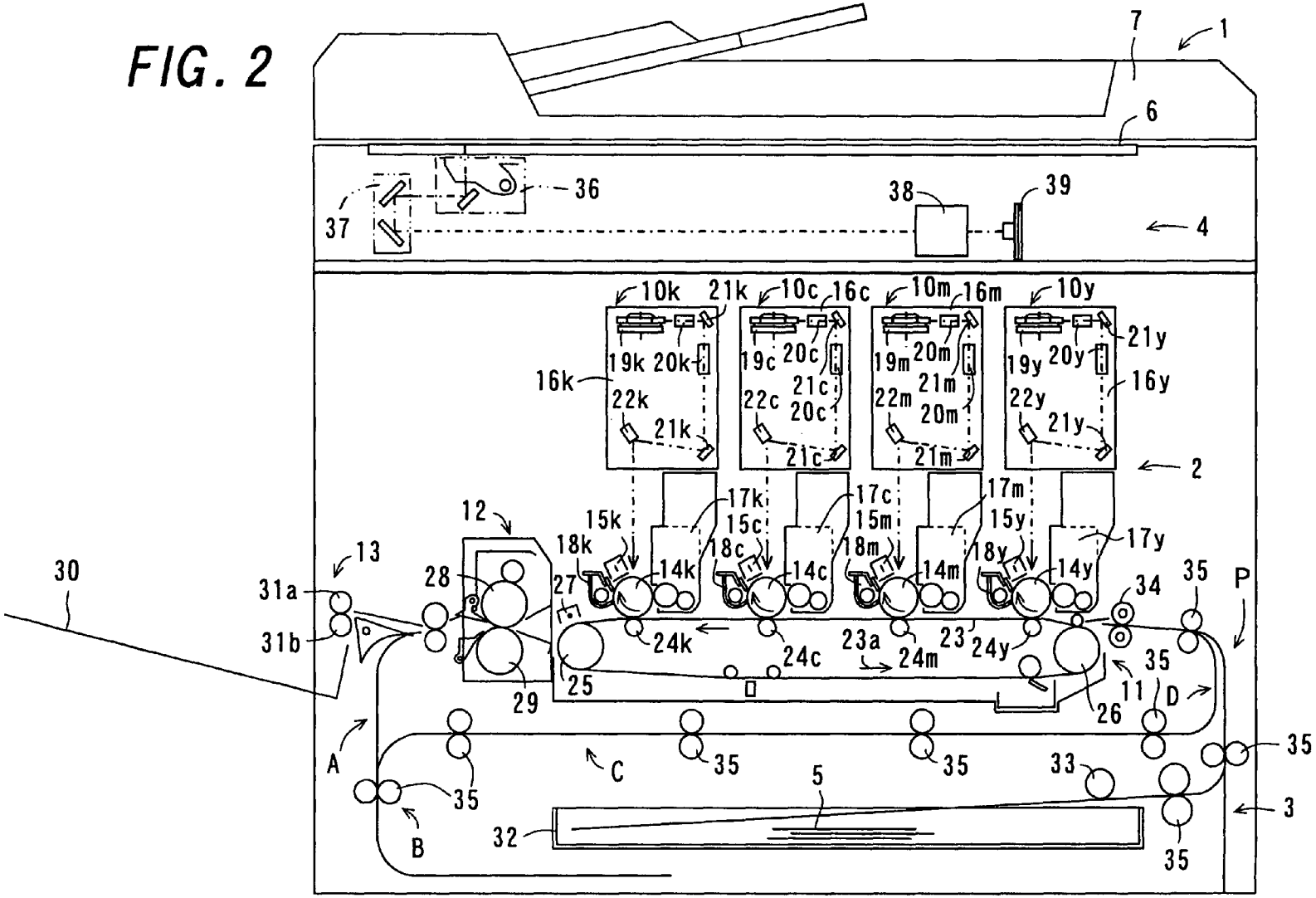
FIG. 2 is a view graphically showing the constitution of an image forming apparatus of the first embodiment of the invention.

FIG. 2 is a view graphically showing the constitution of an image forming apparatus 1 of the first embodiment of the invention. The image forming apparatus 1 is constructed to include an image forming section 2 for forming an image on a recording medium 5; a paper feeding section 3 for feeding the recording medium 5 to the image forming section 2; and an image reading section 4 for reading the image of an original put on an original platen 6.

The image forming section 2 is constructed to include image forming units 10*y*, 10*m*, 10*c*, 10*k*; a transfer unit 11; a fixing unit 12; and a paper discharging unit 13.

The image forming units 10*y*, 10*m*, 10*c* and 10*k* are arranged in a line in that order in the side-operation direction, which is the moving (rotating) direction of the recording medium carrier, which is the transportation belt 23, or that is, from the upstream side in the direction of the arrow 23*a*; and they act to form an electrostatic latent image corresponding to the image information of each color on the surfaces of image-carriers, photoreceptors 14*y*, 14*m*, 14*c* and 14*k*, and to develop the electrostatic latent image to form a toner image of each color. Specifically, the image forming unit 10*y* forms a toner image corresponding to the image information of yellow; the image forming unit 10*m* forms a toner image corresponding to the image information of magenta; the image forming unit 10*c* forms a toner image corresponding to the image information of cyan; and the image forming unit 10*k* forms a toner image corresponding to the image information of black.

The image forming unit 10*y* includes a photoreceptor 14*y*, a charging section 15*y*, an exposure unit 16*y*, a developing section 17*y* and a cleaning section 18*y*.

The photoreceptor 14*y* is a roller member pivotally fitted to the system and driven by a rotary driving mechanism (not shown), on which an electrostatic latent image is formed. The rotary driving mechanism for the photoreceptor 14*y* is controlled by the control section having a CPU (central processing unit). The photoreceptor 14*y* is constructed to include, for example, a cylindrical or columnar conductive substrate (not shown), and a photosensitive layer (not shown) formed on the surface of the conductive substrate. For the conductive substrate, for example, usable is an aluminium bare tube. The photosensitive layer may be formed by laminating a charge-generating layer containing a charge-generating substance and a charge-transporting layer containing a charge-transporting substance, or may be a single layer that contains both a charge-generating substance and a charge-transporting substance. An undercoat layer may be provided between the photosensitive layer and the conductive support. Further, a protective layer may be provided on the surface of the photosensitive layer.

The charging section 15*y* acts to charge the surface of the photoreceptor 14*y* at a potential of predetermined polarity. In this embodiment, a non-contact corona charger is used for the charging section 15*y*. Not limited to the corona charger, the charging section 15*y* may also be any other contact-type charger such as a charging roller and a charging brush. In this embodiment, the charging section 15*y* acts to charge the surface of the photoreceptor 14*y* at −600 V.

The exposure unit 16*y* is a device in which the surface of the charged photoreceptor 14*y* is irradiated with signal light (laser light) corresponding to the image information of yellow whereby an electrostatic latent image corresponding to the yellow image information is formed on the photoreceptor surface. This is constructed to include a semiconductor laser element (not shown), a polygonal mirror 19*y*, an fθ lens 20*y*, and mirrors 21*y* and 22*y*. In the semiconductor laser element, inputted is an image signal that corresponds to yellow of the image information of the original put on the original platen 6, from the image reading section 4 to be described hereinunder; and this emits laser light which is dot light modulated according to the image signal. The polygonal mirror 19*y* acts to deflect the laser light from the semiconductor laser element in the main scanning direction. The fθ lens 20*y* and the plural mirrors 21*y* and 22*y* act to lead the laser light as deflected by the polygonal mirror 19*y*, onto the surface of the photoreceptor 14*y* to form an image thereon. In this embodiment, the exposure unit 16*y* forms an electrostatic latent image corresponding to the yellow image information at an exposure potential of −70V, on the surface of the photoreceptor 14*y*.

The developing section 17*y* is disposed to face the surface of the photoreceptor 14*y*, as spaced from the photoreceptor 14*y* by a gap therebetween, and this supplies an yellow toner to the electrostatic latent image formed on the surface of the photoreceptor 14*y* to correspond to the yellow image information, thereby giving an yellow toner image. The developing section 17*y* includes a developing roller, a stirring roller, a developing tank and a toner supply container, all not shown. The developing roller is spaced from the surface of the photoreceptor 14*y* with a slight gap therebetween via the opening part of the developing tank, and is pivotally supported by the developing tank in the counterclockwise direction seen on FIG. 2. This is a roller member having a fixed magnetic pole therein, and this supplies an yellow toner to the electrostatic latent image on the surface of the photoreceptor 14*y*. To the developing roller, given is a developing bias of the same polarity as that of the toner, or that is, of negative polarity, by a developing bias-imparting section (not shown). In this embodiment, a direct current voltage of −240 V is imparted as a developing bias to the developing roller. The stirring roller is a roller member pivotally disposed inside the developing tank, and this acts to supply an yellow toner to the surface of the developing roller. The developing tank houses therein the developing roller and the stirring roller and also a two-component developer of the invention that comprises an yellow toner having a predetermined particle size distribution of the invention and a magnetic carrier. The toner supply container is provided so as to be in contact with the top of the developing tank in the vertical direction thereof, and is made to communicate with the developing tank via a through-hole (not shown) of a toner supply hole formed therein. Since the yellow toner of the invention has good flowability, it may be well supplied to the side of the developing tank with no problem, even though a toner supply roller is not provided near the toner supply hole on the side of the toner supply container. The toner supply system may be constructed as follows: the toner supply container is spaced from the developing tank, and the toner supply container and the developing tank are connected to each other via a toner supply pipe, and via the toner supply pipe, an yellow toner is supplied to the developing tank from the toner supply container. Having such a simple constitution, the inside structure of the image forming apparatus 1 may be simplified, the image forming apparatus 1 may be down-sized, and the production cost of the image forming apparatus 1 may be reduced.

The yellow toner put in the developing tank in this embodiment is negatively charged when stirred with the stirring roller and rubbed with the magnetic carrier, and then this is supplied to the developing roller. The yellow toner put in the developing tank is charged when stirred with the stirring roller, and supplied to the developing roller surface, and then supplied to the electrostatic latent image on the surface of the photoreceptor 14*y* by utilizing the potential difference between the photoreceptor 14*y* and the developing roller, thereby forming a toner image that corresponds to the yellow image information.

The cleaning section 18*y* acts as follows: after the yellow toner image on the surface of the photoreceptor 14*y* has been transferred onto the recording medium 5 held and transported by the transportation belt 23 described hereinunder, the cleaning section removes and recovers the yellow toner still remaining on the surface of the photoreceptor 14*y*. Since the toner having a predetermined particle size distribution of the invention can be readily removed from the photoreceptor surface, the cleaning section 18*y* may have a simple structure comprising, for example, a cleaning blade provided so as to be in contact with the photoreceptor surface and a waste toner receiver for the waste toner to be removed from the photoreceptor surface by the cleaning blade. Accordingly, the inside stricture of the image forming apparatus 1 may be simplified, and the production cost of the apparatus can be reduced.

In the image forming unit 10*y*, the surface of the photoreceptor 14*y* is charged by the charging section 15*y* while the photoreceptor 14*y* is pivoted, then the charged surface of the photoreceptor 14*y* is irradiated with signal light corresponding to the image information of yellow from the exposure unit 16*y*, thereby forming thereon an electrostatic image corresponding to the yellow image information, and an yellow toner is supplied to the electrostatic latent image by the developing section 17 to thereby form an yellow toner image. The yellow toner image is transferred onto the recording medium 5 that is held and transported by the transportation. belt 23 running in the direction of the arrow 23*a* while kept in contact under pressure with the surface of the photoreceptor 14*y*, as described hereinunder. The yellow toner still remaining on the surface of the photoreceptor 14*y* after the toner image transference is removed and recovered by the cleaning section 18*y*.

The image forming units 10*m*, 10*c* and 10*k* each have a structure similar to that of the image forming unit 10*y* except that they use a magenta toner, a cyan toner or a black toner, respectively. Accordingly, the same reference numerals are given to them, which are terminated with "m" indicating magenta, "c" indicating cyan or "k" indicating black, respectively, and their descriptions are omitted.

The transfer unit 11 is constructed to include the transportation belt 23, transfer rollers 24*y*, 24*m* 24*c* and 24*k*, a driving roller 25, a driven roller 26 and a charge removing section 27.

The transportation belt 23 is an endless belt member, and this is provided pivotally in the side-operation direction, or that is, in the direction of the arrow 23*a* so as to be brought into contact under pressure with the image carriers of photoreceptors 14*y*, 14*m*, 14*c* and 14*k* in that order, and this forms a loop-like moving route while held under tension by the driving roller 25 and the driven roller 26. Specifically, this is a recording medium carrier that holds and carries the recording medium 5 thereon. The position at which the transportation belt 23 is in contact under pressure with the photoreceptors 14*y*, 14*m*, 14*c* and 14*k* is the color toner image transfer position. The transportation belt 23 carries and transports thereon the recording medium 5 that is supplied in the paper feeding section 3 as described hereinunder, and the respective color toner images are transferred onto the recording medium 5, as superposed thereon at the transfer positions of the photoreceptors 14*y*, 14*m*, 14*c* and 14*k*, thereby forming a multicolor toner image.

The transfer rollers 24*y*, 24*m*, 24*c* and 24*k* are roller members that are pivotally provided and driven by a driving mechanism (not shown) while kept in contact under pressure with the photoreceptors 14*y*, 14*m*, 14*c* and 14*k*, respectively, via the transportation belt 23 therebetween. The contact positions between the transfer rollers 24*y*, 24*m*, 24*c* and 24*k*, and the photoreceptors 14*y*, 14*m*, 14*c* and 14*k* are the positions at which the respective color toner images are transferred onto the recording medium 5 that is held and transported by the transportation belt 23. To the transfer rollers 24*y*, 24*m*, 24*c* and 24*k*, applied is a transfer bias of polarity opposite to the charge polarity of the toner in order to transfer the toner images on the surfaces of the photoreceptors 14*y*, 14*m*, 14*c* and 14*k* onto the recording medium 5 held and transported by the transportation belt 23.

The driving roller 25 is a roller member that is provided to be rotatable by a driving mechanism (not shown), and this rotates and drives the transportation belt 23. The driving roller 24 is controlled by the control section having the CPU.

The driven roller 26 is a roller member that is provided so as to be driven by the rotation of the transportation belt 23, and this functions as a tension roller that gives a predetermined tension to the transportation belt 23.

The charge removing section 27 is provided on the downstream side after the contact position between the photoreceptor 14*k* and the transfer roller 24*k* and on the upstream side before the nearest contact position between the transportation belt 23 and the fixing unit 12, in the rotating and driving direction of the transportation belt 23, or that is, in the direction of the arrow 23*a*. To the charge removing section 27, applied is an alternating current voltage by an alternating current voltage applying section (not shown), whereby this means removes charge of the transportation belt 23 in order that the recording medium 5 electrostatically adsorbed by the transportation belt 23 could be readily separated from the transportation belt 23 and that the recording medium 5 could be thereby readily and smoothly transferred from the transportation belt 23 to the fixing unit 12.

In the transfer unit 11, the respective color toner images formed on the photoreceptors 14*y*, 14*m*, 14*c* and 14*k* are transferred onto a predetermined position of the recording medium 5 held and transported by the transportation belt 23, as superposed thereon, to thereby form a multi-color toner image. The recording medium 5 thus carrying thereon the multi-color toner image is then led to the fixing unit 12.

The fixing unit 12 includes a heating roller 28 and a pressure roller 29. The heating roller 28 is provided to be pivotal by a driving mechanism (not shown). A heating section such as a halogen lamp is provided inside the heating roller 28. The pressure roller 29 is provided in contact under pressure with the heating roller 28 so that it is rotatable by a driving mechanism (not shown) and is driven by the driving rotation of the heating roller 28. The multi-color toner image-carrying recording medium 5 is transferred by the transportation belt 23 to the contact area between the heating roller 28 and the pressure roller 29, in which the multi-color toner image receives heat and pressure and is thereby fixed on the recording medium 5.

In the fixing unit 12, the recording medium 5 carrying the multi-color toner image is heated under pressure in the contact area between the heating roller 28 and the pressure roller 29, whereby the multi-color toner image is fixed on the recording medium 5. The recording medium 5 on which the multi-color toner image has been thus fixed in the fixing unit 12 is then transported to the paper discharging unit 13 in the image forming apparatus 1.

The paper discharging unit 13 is constructed to include a paper discharging tray 30 and paper discharging rollers 31*a* and 31*b*. The paper discharging tray 30 is disposed outside the casing of the image forming apparatus 1, and this receives and keeps therein the recording medium 5 on which the toner image has been fixed that is discharged out from the image forming apparatus 1. The paper discharging rollers 31*a* and 31*b* are disposed inside the image forming apparatus 1, near to a paper discharging port (not shown) formed in the casing of the image forming apparatus 1, and these act to lead the recording medium 5 on which the toner image has been fixed that is transported from the fixing unit 12, out of the image forming apparatus 1 to be put on the paper discharging tray 30. In the paper discharging unit 13, the toner image-fixed recording medium 5 is led out onto the paper discharging tray 30 outside the image forming apparatus 1.

In the image forming section 2, the respective color toner images corresponding to image information are formed on the surfaces of the photoreceptors 14*y*, 14*m*, 14*c* and 14*k*, and they are transferred onto the recording medium 5 on the transportation belt 23, as superposed thereon, to thereby form a multi-color toner image, and the multi-color toner image is fixed on the recording medium 5 in the fixing unit 12, whereby the multi-color toner image-fixed recording medium 5 is led out onto the paper discharging tray 30.

The paper feeding section 3 is constructed to include a recording medium cassette 32, a pickup roller 33, a registration roller 34, and a recording medium transportation roller 35. The recording medium cassette 32 houses therein the recording medium 5, for example, sheets of ordinary paper of various size such B5, B4, A4 or A4 size paper; sheets of recording paper such as color copying paper; or overheat projector sheets (OHP sheets). The pickup roller 33 acts to supply the recording medium 5 housed in the recording medium cassette 32, one by one to the transportation route P. The registration roller 34 acts to supply the recording medium 5 onto the transportation belt 23, in synchronization with the transportation of the toner image from the photoreceptor 14*y* to the transfer position, or that is, to the contact position between the photoreceptor 14*y* and the transfer roller 24*y*, and acts to supply the recording medium 5 to that transfer position. The recording medium transportation roller 35 acts to assist the transportation of the recording medium 5 to the registration roller 34 in the transportation route P. In a case where an image is formed on both surfaces of the recording medium 5, a toner image is fixed on one surface of the medium in the fixing unit 12, and then the medium is transported via the transportation route A, the transportation route B, the transportation route C and the transportation route D, and again led to the image forming section 2, in which a toner image is transferred onto the other surface of the medium and then fixed thereon. The recording medium 5 led to the transportation route A is led back in the inverse direction by the recording medium transportation roller 35 in the transportation route B, and then led toward the transportation route C. In the paper feeding section 3, the recording medium 5 is supplied onto the transportation belt 23 one by one, in synchronization with the transportation of the toner image from the photoreceptor 14*y* toward the transfer position, or that is, toward the contact area between the photoreceptor 14*y* and the transfer roller 24*y*.

The image reading section 4 is constructed to include the original platen 6, a cover 7, a first original scanning unit 36, a second original scanning unit 37, an optical lens 38 and a CCD (charge coupled device) line sensor.

An upper surface of the original platen 6 functions as an original-bearing face on which an original is put. The cover 7 is supported on the original platen 6 so that the upper surface of the original platen 6 can be opened and shut. Putting an original on the original platen 6 may be effected by a user by hand, or may be effected by an automatic original feeder (not shown) provided in the cover 7.

The first original scanning unit 36 is so provided that it can move back and forth at a constant scanning speed in parallel to the original platen, while spaced from a lower surface of the original platen 6 by a constant distance therebetween, and it includes an exposure lamp for lighting the surface of the original image, and a first mirror for deflecting the reflected light image from the original toward the direction of the second original scanning unit 37.

The second original scanning unit 37 is so provided that it can move back and forth in parallel to the first original scanning unit 36, at a constant speed relative to the speed of the first original scanning unit 36, and it includes a second mirror and a third mirror for further deflecting the reflected light image from the original, which was deflected by the first mirror of the first original scanning unit 36, toward the direction of the optical lens 38.

The optical lens 38 acts to reduce the reflected light image from the original, which was deflected by the third mirror of the second original scanning unit 37, and to lead the thus-reduced light image to a predetermined position on the CCD line sensor 39 to thereby from an image thereon. The CCD line sensor 39 acts to successively convert the formed light image into an electric signal through photoelectric conversion, and to output it. The CCD line sensor 39 reads a monochrome image or a color image, and converts the image information into an electric signal of each color, and then outputs it into the exposure units 16*y*, 16*m*, 16*c* and 16*k*.

In the image reading section 4, the image information is read from the original put on the original platen 6, and the image information is converted into an electric signal of each color and is outputted to the exposure units 16*y*, 16*m*, 16*c* and 16*k*.

In the image forming apparatus 1, the respective toner images are formed on the basis of the image information read in the image reading section 4, and these are transferred and fixed on the recording medium 5 to form thereon the image based on the original.

In this embodiment, the image forming apparatus is a direct transfer system of directly transferring the toner images from the photoreceptors 14*y*, 14*m*, 14*c* and 14*k* onto the recording medium 5. However, not being limited to the direct transfer system, the image forming apparatus of the invention may also be an intermediate transfer system where the toner image on a photoreceptor is once transferred onto an intermediate transfer medium such as an intermediate transfer belt and thereafter the toner image thus transferred onto the intermediate transfer medium is then transferred onto a recording medium.

EXAMPLES

The invention is described more concretely with reference to the following Examples and Comparative Examples.

The particle size and the circularity of the toner particles obtained were determined as follows:

[Method of Particle Size Measurement]

First prepared is a sample for measurement. 20 ml of an aqueous 1 wt. % solution of sodium chloride (first class grade chemical) (electrolytic solution) is put into a 100-ml beaker. 0.5 ml of alkylbenzenesulfonic acid salt (dispersant) and 3 mg of a toner sample are added thereto in that order and ultrasonically dispersed for 5 minutes. An aqueous 1 wt. % solution of sodium chloride (first class grade chemical) is added thereto to make the overall volume 100 ml, and again ultrasonically dispersed for 5 minutes to prepare a sample for measurement. Using Coulter Counter TA-III (trade name by Coulter), the sample is analyzed under the following condition: the aperture diameter is 100 μm, and the size of the particles to be analyzed is from 2 to 40 μm based on the number thereof. From the data, the numerical values to define the invention are derived through computation.

[Method of Circularity Measurement]

A sample for measurement is prepared in the same manner as that in the method of particle size measurement. Using a flow-type particle image analyzer (FPIA-2000 Model, trade name by Sysmex), still images of the toner particles dispersed in the sample are taken and analyzed to obtain the projected area and the peripheral length of the particle image, and the degree of circularity of the particles is obtained according to the following formula:

Degree of Circularity=(peripheral length of the circle having the same area as the projected area of particle)/(peripheral length of the projected image of particle).

From 2000 to 5000 particles of one sample are analyzed for the degree of circularity thereof, and the data are averaged to obtain a mean value thereof. When the particle image is a true circle, then the degree of circularity of the particle is 1; and when the surface profile is more complicated, then the degree of the circularity is smaller.

Examples 1 to 20, and Comparative Examples 1 to 36

TABLE 1

| | Colorant | |
|---|---|---|
| Type of Toner | Type | Blend Ratio |
| Magenta | C.I. Pigment Red 122 | 4.5 parts by weight |
| Cyan | C.I. Pigment Blue 15:3 | 6.0 parts by weight |
| Yellow | C.I. Pigment Yellow 17 | 5.0 parts by weight |
| Black | Carbon Black | 5.0 parts by weight |

The blend ratio of the colorant is in terms of the pigment alone. In fact, however, herein used was a master batch containing polyester and one pigment and having a particle size of from 2 to 3 mm, in which the pigment content is 40% by weight of the total amount of the polyester and the pigment.

45 kg of a toner material containing 100 parts by weight of a polyester (binder resin, Hymer, trade name by Sanyo Chemical), the predetermined amount of the colorant as in Table 1 and 2.0 parts by weight of zinc salicylate (TN-105, trade name by Hodogaya Chemical Industry) in that blend ratio (by weight) was mixed in a Henschel mixer (FM Mixer, trade name by Mitsui Mining) for 10 minutes. The material mixture was kneaded in a double-screw extrusion kneader (PCM65, trade name by Ikegai), cooled to room temperature, and then roughly ground with a cutter mill (VM-16, trade name by Orient). Next, this was finely ground in a fluidized-bed jet grinder (by Hosokawa Micron), and then classified with a rotary pneumatic classifier (by Hosokawa Micron) to produce a non-magnetic toner. In this step, the devices were controlled as follows to produce non-magnetic toners of four colors. The number of revolution of the rotor of the fluidized-bed jet grinder is from 2500 to 4850 rpm; the number of revolution of the rotor of the rotary pneumatic classifier is from 3100 to 3950 rpm; the amount of the rough powder fed to the rotary pneumatic classifier is from 15 to 50 kg/h; and the air flow rate in the rotary pneumatic classifier is from 13 to 17 $Nm^3/m$. Examples 1 to 5 and Comparative Examples 1 to 9 are magenta toners; Examples 6 to 10 and Comparative Examples 10 to 18 are cyan toners; Examples 11 to 15 and Comparative Examples 19 to 27 are yellow toners; and Examples 16 to 20 and Comparative Examples 28 to 36 are black toners.

The particle size distribution and the mean degree of circularity of the non-magnetic toners obtained in the above are shown in Tables 2 to 5. The toners of four colors of Examples 1 to 20 and Comparative Examples 1 to 36 were all on the same level in point of the particle size distribution and the mean degree of circularity thereof.

TABLE 2

| | | Particle Size Distribution | | | | | |
|---|---|---|---|---|---|---|---|
| | | $D_{50v}$ μm | Particles having a particle size of at most 5 μm % by number | $(D_{10v}-D_{90v})/D_{10v}$ | $(D_{50v}-D_{90v})/D_{50v}$ | Particles having a particle size of from 3 to 5 μm % by number | Mean Degree of Circularity |
| Examples | 1 | 5.6 | 33.9 | 0.417 | 0.149 | 30.8 | 0.956 |
| | 2 | 6.3 | 30.4 | 0.423 | 0.223 | 29.6 | 0.954 |
| | 3 | 6.7 | 18.5 | 0.445 | 0.217 | 16.1 | 0.951 |
| | 4 | 7.2 | 17.9 | 0.441 | 0.255 | 15.5 | 0.953 |
| | 5 | 7.5 | 20.2 | 0.470 | 0.237 | 13.1 | 0.954 |
| Comparative Examples | 1 | 4.9 | 50.0 | 0.268 | 0.163 | 42.3 | 0.956 |
| | 2 | 6.1 | 37.0 | 0.428 | 0.163 | 34.5 | 0.953 |
| | 3 | 6.3 | 33.4 | 0.481 | 0.240 | 29.1 | 0.952 |
| | 4 | 6.9 | 14.5 | 0.490 | 0.253 | 15.0 | 0.955 |
| | 5 | 7.5 | 13.7 | 0.488 | 0.324 | 13.8 | 0.950 |
| | 6 | 7.8 | 11.5 | 0.501 | 0.153 | 9.1 | 0.954 |
| | 7 | 7.9 | 12.3 | 0.521 | 0.258 | 11.9 | 0.948 |
| | 8 | 8.4 | 10.4 | 0.536 | 0.246 | 13.5 | 0.943 |
| | 9 | 10.2 | 12.1 | 0.591 | 0.400 | 9.7 | 0.949 |

TABLE 3

| | | Particle Size Distribution | | | | | |
|---|---|---|---|---|---|---|---|
| | | $D_{50V}$ μm | Particles having a particle size of at most 5 μm % by number | $(D_{10V}-D_{90V})/D_{10V}$ | $(D_{50V}-D_{90V})/D_{50V}$ | Particles having a particle size of from 3 to 5 μm % by number | Mean Degree of Circularity |
| Examples | 6 | 5.5 | 30.3 | 0.420 | 0.135 | 28.9 | 0.951 |
| | 7 | 6.5 | 29.2 | 0.422 | 0.165 | 20.1 | 0.943 |
| | 8 | 6.8 | 20.3 | 0.455 | 0.182 | 21.3 | 0.950 |
| | 9 | 7.1 | 16.2 | 0.468 | 0.195 | 16.2 | 0.953 |
| | 10 | 7.7 | 15.8 | 0.470 | 0.240 | 15.2 | 0.942 |
| Comparative Examples | 10 | 4.7 | 52.3 | 0.254 | 0.158 | 33.3 | 0.947 |
| | 11 | 6.1 | 36.7 | 0.419 | 0.164 | 33.3 | 0.947 |
| | 12 | 6.4 | 35.1 | 0.470 | 0.238 | 27.5 | 0.953 |
| | 13 | 7.0 | 16.3 | 0.480 | 0.254 | 16.3 | 0.954 |
| | 14 | 7.6 | 14.9 | 0.490 | 0.333 | 15.8 | 0.951 |
| | 15 | 7.9 | 11.5 | 0.480 | 0.152 | 10.3 | 0.951 |
| | 16 | 8.0 | 16.1 | 0.506 | 0.260 | 11.9 | 0.951 |
| | 17 | 9.2 | 14.9 | 0.555 | 0.244 | 12.9 | 0.951 |
| | 18 | 11.3 | 10.3 | 0.604 | 0.389 | 10.0 | 0.942 |

TABLE 4

| | | Particle Size Distribution | | | | | |
|---|---|---|---|---|---|---|---|
| | | $D_{50V}$ μm | Particles having a particle size of at most 5 μm % by number | $(D_{10V}-D_{90V})/D_{10V}$ | $(D_{50V}-D_{90V})/D_{50V}$ | Particles having a particle size of from 3 to 5 μm % by number | Mean Degree of Circularity |
| Examples | 11 | 5.1 | 34.8 | 0.415 | 0.148 | 30.6 | 0.955 |
| | 12 | 6.4 | 30.1 | 0.426 | 0.160 | 29.7 | 0.947 |
| | 13 | 6.8 | 18.2 | 0.448 | 0.219 | 15.9 | 0.952 |
| | 14 | 7.1 | 16.9 | 0.443 | 0.253 | 15.7 | 0.953 |
| | 15 | 7.8 | 15.5 | 0.472 | 0.240 | 13.3 | 0.955 |
| Comparative Examples | 19 | 4.7 | 52.4 | 0.233 | 0.166 | 42.4 | 0.957 |
| | 20 | 6.1 | 36.1 | 0.430 | 0.168 | 34.8 | 0.955 |
| | 21 | 6.4 | 32.9 | 0.481 | 0.233 | 28.7 | 0.947 |
| | 22 | 6.5 | 17.2 | 0.485 | 0.255 | 16.1 | 0.955 |
| | 23 | 7.2 | 18.3 | 0.489 | 0.320 | 12.9 | 0.955 |
| | 24 | 7.7 | 11.9 | 0.500 | 0.155 | 8.8 | 0.949 |
| | 25 | 8.0 | 13.5 | 0.509 | 0.261 | 9.1 | 0.947 |
| | 26 | 8.5 | 12.9 | 0.553 | 0.271 | 10.3 | 0.945 |
| | 27 | 10.3 | 10.4 | 0.610 | 0.290 | 9.7 | 0.950 |

TABLE 5

| | | Particle Size Distribution | | | | | |
|---|---|---|---|---|---|---|---|
| | | $D_{50V}$ μm | Particles having a particle size of at most 5 μm % by number | $(D_{10V}-D_{90V})/D_{10V}$ | $(D_{50V}-D_{90V})/D_{50V}$ | Particles having a particle size of from 3 to 5 μm % by number | Mean Degree of Circularity |
| Examples | 16 | 5.5 | 34.2 | 0.419 | 0.160 | 31.3 | 0.950 |
| | 17 | 6.1 | 30.3 | 0.426 | 0.162 | 28.9 | 0.941 |
| | 18 | 6.6 | 17.6 | 0.447 | 0.218 | 16.2 | 0.953 |
| | 19 | 7.2 | 16.7 | 0.443 | 0.260 | 15.5 | 0.954 |
| | 20 | 7.6 | 15.3 | 0.474 | 0.239 | 13.6 | 0.952 |
| Comparative Examples | 28 | 4.8 | 51.2 | 0.262 | 0.164 | 44.2 | 0.955 |
| | 29 | 6.4 | 36.9 | 0.422 | 0.177 | 33.8 | 0.951 |
| | 30 | 6.5 | 33.2 | 0.480 | 0.255 | 28.5 | 0.956 |
| | 31 | 7.0 | 17.9 | 0.485 | 0.248 | 15.5 | 0.944 |
| | 32 | 7.7 | 16.5 | 0.493 | 0.330 | 12.7 | 0.952 |
| | 33 | 7.9 | 10.8 | 0.501 | 0.150 | 8.8 | 0.954 |
| | 34 | 8.0 | 10.2 | 0.522 | 0.142 | 10.2 | 0.947 |
| | 35 | 8.6 | 9.3 | 0.536 | 0.332 | 9.3 | 0.945 |
| | 36 | 11.0 | 7.8 | 0.556 | 0.488 | 7.5 | 0.947 |

Examples 21 to 25, and Comparative Examples 37 to 45

100 parts by weight of the magenta toner obtained in Examples 1 to 5 and Comparative Examples 1 to 9, and 1.0 part by weight of negatively-charged hydrophobic silica (volume-average particle size, 10 nm) were mixed in a Henschel mixer for 5 minutes to prepare an external non-magnetic toner. Next, 5 parts by weight of the external non-magnetic toner and 95 parts of a ferrite carrier (volume-average particle size, 45 μm) were mixed in a V-type mixer (V-5, trade name by Tokuju Kosakusho) for 20 minutes to prepare two-component developers of Examples 21 to 25 and Comparative Examples 37 to 45.

The two-component developers of Examples 21 to 25 and Comparative Examples 37 to 45 were evaluated for their flowability according to the method mentioned below. In addition, the two-component developer of Examples 21 to 25 and Comparative Examples 37 to 45 was charged in a commercially-available copier (AR-C280, trade name by Sharp—this is an image forming apparatus using a two-component developer), and tested for the presence or absence of image fogging, the cleanability, and the image reproducibility (fine line reproducibility). Based on these, the developers were generally evaluated. The results are shown in Table 6.

[Flowability]

Using a bulk density meter (by Tsutsui Rikagaku Kiki), the developers was evaluated for their flowability according to JIS K-5101-12-1. When the bulk density is larger, then the flowability of the sample is better. The samples were ranked in three: those having a bulk density of less than 0.350 are bad (poor flowability); those having a bulk density of from 0.350 to 0.370 are not so good (somewhat poor flowability); and those having a bulk density of more than 0.370 are good (good flowability).

[Fogging]

The printed images in the initial stage of copying operation were tested for the fogging in the non-image area thereof, using a color-difference meter (Color Meter ZE2000, trade name by Nippon Denshoku Kogyo). Briefly, the difference between the degree of whiteness in the non-image area (WB value) and the degree of whiteness of the transfer paper was determined, and this indicates the degree of image fogging. When the value is smaller, then the image fogging is smaller. The samples having a difference value of less than 0.5 are good; those having a difference value of from 0.5 to less than 1.5 are average (no problem in practical use); and those having a difference value of 1.5 or more are bad.

[Cleanability]

10,000 copies were made continuously, and the photoreceptor was visually checked for cleaning failure. The samples not causing cleaning failure are good; and those having caused cleaning failure are bad.

[Image Reproducibility (Fine Line Reproducibility)]

Using a digital high-definition microscope (BS-7800, trade name by Sonic), a one-dot line image was 200-fold enlarged and outputted on a monitor, and this was observed with a microscope and evaluated in 3 ranks. The evaluation criteria are as follows:

Good: The image quality is good (the line is continuously reproduced, and the line width does not fluctuate).

Average: No problem in practical use (no missing line, but the line width fluctuates).

Bad: The image quality is bad (some missing lines or the line width greatly fluctuates, and the lines are not sufficiently reproduced).

[Resolution]

A resolution chart was outputted, and checked for the resolution of fine lines of 1200 dpi. The developers were evaluated according to the following criteria:

Good: Fine lines are completely separated.

Not so good: Fine line separation is incomplete.

Bad: Fine lines do not separate.

[General Evaluation]

The samples were generally evaluated as in the following four ranks: Excellent, Good, Average, and Bad.

TABLE 6

| | | Flowability | Fogging | Cleanability | Image Reproducibility | Resolution | General Evaluation |
|---|---|---|---|---|---|---|---|
| Examples | 21 | Not so good | Average | Good | Good | Good | Good |
| | 22 | Good | Good | Good | Good | Good | Excellent |
| | 23 | Good | Good | Good | Good | Good | Excellent |
| | 24 | Good | Good | Good | Good | Good | Excellent |
| | 25 | Good | Good | Good | Good | Good | Excellent |
| Comparative Examples | 37 | Bad | Bad | Bad | Average | Not so good | Bad |
| | 38 | Bad | Average | Bad | Good | Good | Bad |
| | 39 | Not so good | Average | Average | Good | Not so good | Average |
| | 40 | Good | Average | Good | Average | Not so good | Average |
| | 41 | Good | Average | Good | Bad | Not so good | Average |
| | 42 | Good | Good | Good | Bad | Not so good | Average |
| | 43 | Good | Good | Good | Bad | Bad | Bad |
| | 44 | Not so good | Good | Good | Bad | Bad | Bad |
| | 45 | Good | Average | Good | Bad | Bad | Bad |

Table 6 confirms that the two-component developers of the invention satisfy all the requirements of flowability, fogging resistance, cleanability, image reproducibility and resolution, at high level.

Other toners than the magenta toners were tested and evaluated in the same manner, and had the same results. The invention may be embodied in other specific forms without departing from the spirit or essential characteristics thereof.

The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A non-magnetic toner comprising:

a binder resin; and a colorant, wherein the particle size $D_{10V}$ where a cumulative volume from the large particle size side in the cumulative volume distribution reaches 10%, and the particle size $D_{90V}$ where a cumulative volume from the large particle size side in the cumulative volume distribution reaches 90% satisfy the following formula (1), the particle size $D_{50V}$ where a cumulative volume from the large particle size side in the cumulative volume distribution reaches 50% falls within a range of from 5.1 to 7.8 μm (5.1 μm or more and 7.8 μm or less), and a content of the toner particles having a particle size of at most 5 μm is from 15 to 35% by number (15% by number or more and 35% by number or less), and the particle size $D_{50V}$ and the particle size $D_{90V}$ satisfy the following formula (2):

$$0.415 \leqq (D_{10V} - D_{90V})/D_{10V} \leqq 0.475 \quad (1)$$

$$0.160 < (D_{50V} - D_{90V})/D_{50V} < 0.255 \quad (2).$$

2. The non-magnetic toner of claim 1, wherein a content of the toner particles having a particle size of from 3 to 5 μm is from 13 to 30% by number.

3. The non-magnetic toner of claim 1, wherein a mean degree of circularity of the toner particles is from 0.94 to 1.0.

4. The non-magnetic toner of claim 1, wherein the non-magnetic toner is produced by roughly grinding a melt-kneaded material of a binder resin and a master batch containing a colorant, and then finely grinding and classifying the resultant with a fluidized-bed jet grinder.

5. A two-component developer comprising:

the non-magnetic toner of claim 1; and a carrier.

6. The two-component developer of claim 5, wherein the particle size of the carrier is from 30 to 50 μm.

* * * * *